US008897670B2

(12) United States Patent
Okabe

(10) Patent No.: US 8,897,670 B2
(45) Date of Patent: Nov. 25, 2014

(54) DEVELOPING CARTRIDGE AND PROCESS UNIT

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 168 days.

(21) Appl. No.: 13/294,208

(22) Filed: Nov. 11, 2011

(65) Prior Publication Data

US 2012/0121292 A1 May 17, 2012

(30) Foreign Application Priority Data

Nov. 12, 2010 (JP) ..... 2010-254088

(51) Int. Cl.
*G03G 21/16* (2006.01)

(52) U.S. Cl.
USPC ..... 399/113; 399/119

(58) Field of Classification Search
USPC ..... 399/113, 119
See application file for complete search history.

(56) References Cited

U.S. PATENT DOCUMENTS

| | | | | |
|---|---|---|---|---|
| 6,041,203 | A | 3/2000 | Suzuki et al. | |
| D471,228 | S | 3/2003 | Okabe et al. | |
| D471,583 | S | 3/2003 | Okabe et al. | |
| 7,298,990 | B2 * | 11/2007 | Nishimura | 399/113 |
| 7,603,057 | B2 | 10/2009 | Shiraki et al. | |
| 7,747,192 | B2 | 6/2010 | Sato | |
| 7,890,021 | B2 * | 2/2011 | Yuzawa | 399/119 |
| 2002/0028088 | A1 | 3/2002 | Okabe et al. | |
| 2003/0049046 | A1 | 3/2003 | Okabe | |
| 2005/0191090 | A1 | 9/2005 | Nishimura | |
| 2006/0257163 | A1 | 11/2006 | Sato | |
| 2007/0160388 | A1 | 7/2007 | Yoshimura et al. | |
| 2007/0280733 | A1 | 12/2007 | Shiraki et al. | |
| 2010/0166453 | A1 * | 7/2010 | Okabe | 399/111 |
| 2010/0260516 | A1 | 10/2010 | Sato | |

FOREIGN PATENT DOCUMENTS

| | | | |
|---|---|---|---|
| CN | 1428666 | A | 7/2003 |
| CN | 1661500 | A | 8/2005 |
| CN | 1881109 | A | 12/2006 |
| JP | 60-102663 | A | 6/1985 |
| JP | 61-230159 | A | 10/1986 |
| JP | H05-341635 | A | 12/1993 |
| JP | 2003-084647 | | 3/2003 |
| JP | 2006-343359 | | 12/2006 |
| JP | 2007-322553 | A | 12/2007 |

OTHER PUBLICATIONS

First Office Action issued in corresponding Chinese Patent Application No. 201110357886.1 mailed Mar. 25, 2013.
Second Office Action issued in corresponding Chinese Patent Application No. 201110357886.01 mailed Dec. 18, 2013.
Japanese Office Action for applicaiton No. 2010-254088 mailed Sep. 2, 2014.

* cited by examiner

*Primary Examiner* — Gregory H Curran
(74) *Attorney, Agent, or Firm* — Banner & Witcoff, Ltd.

(57) ABSTRACT

A developing cartridge includes: a developing roller configured to rotate about an first axis extending in a first direction, the developing roller having a first side and a second side opposite to the first side in the first direction; a case including a first wall disposed at the first side of the developing roller and a second wall disposed at the second side of the developing roller; an arm configured to be supported by the first wall of the case and configured to swing between a first posture and a second posture about an second axis extending the first direction, the arm including a first protrusion projecting from the arm in the first direction.

20 Claims, 18 Drawing Sheets

DEVELOPING CARTRIDGE AND PROCESS UNIT

CROSS-REFERENCE TO RELATED APPLICATION

This application is based upon and claims the benefit of priority of Japanese Patent Application No. 2010-254088 filed on Nov. 12, 2010, the contents of which are incorporated herein by reference in its entirety.

BACKGROUND

The present disclosure relates to a developing cartridge and a process unit.

In an example of an image forming apparatus such as a laser printer and the like, a drum cartridge holding a photosensitive drum is provided to be detachable in a main body case and a developing cartridge holding a developing roller is mounted on the drum cartridge. The drum cartridge and the developing cartridge mounted thereon together form a process unit.

A pressing mechanism for pressing the developing roller to the photosensitive drum is provided in the main body case. An engaging part is pressed part) is formed to protrude from the side wall of the developing cartridge. The pressing mechanism includes a pair of holding bodies sandwiching the engaging part therebetween and a biasing spring biasing one side of the holding bodies. One of the holding bodies is biased by the biasing spring and the engaging part is pressed by the holding body, such that the developing roller is pressed to the photosensitive drum.

In order to separate the developing roller from the photosensitive drum, a cam is provided in a state where a circumferential surface thereof contacts the other side of the holding bodies. According to a rotating position of the cam, the other of the holding bodies is pressed to one of the holding bodies and the engaging part is pressed by the other of the holding bodies. Accordingly, the developing cartridge moves against a biasing force of the biasing spring to separate the developing roller from the photosensitive drum.

When the developing roller does not rotate, the developing roller is separated from the photosensitive drum, such that it is possible to prevent deformation of the developing roller or the photosensitive drum.

SUMMARY

However, since a gear for driving the developing roller and a member such as an electrode for feeding current to the developing roller and the like are disposed on the side wall of the developing cartridge, a position where the engaging part is formed is sign significantly limited.

An aspect of the present disclosure has been made in an effort to provide a developing cartridge and a process unit capable of increasing the degree of freedom position of a pressed part receiving a pressing force.

According to the aspect of the disclosure, a developing cartridge comprises:

a developing roller configured to rotate about an first axis extending in a first direction, the developing roller having a first side and a second side opposite to the first side in the first direction;

a case including a first wall disposed at the first side of the developing roller and a second wall disposed at the second side of the developing roller; and a first arm configured to be supported by the first wall of the case and configured to swing between a first posture and a second posture about an second axis extending in the first direction, the first arm including a first protrusion projecting from the first arm in the first direction.

DESCRIPTION OF EXEMPLARY EMBODIMENTS

Hereinafter, the exemplary embodiments of the present disclosure will be described in detail with reference to accompanying drawings.

1. Color Printer

Figure 1:
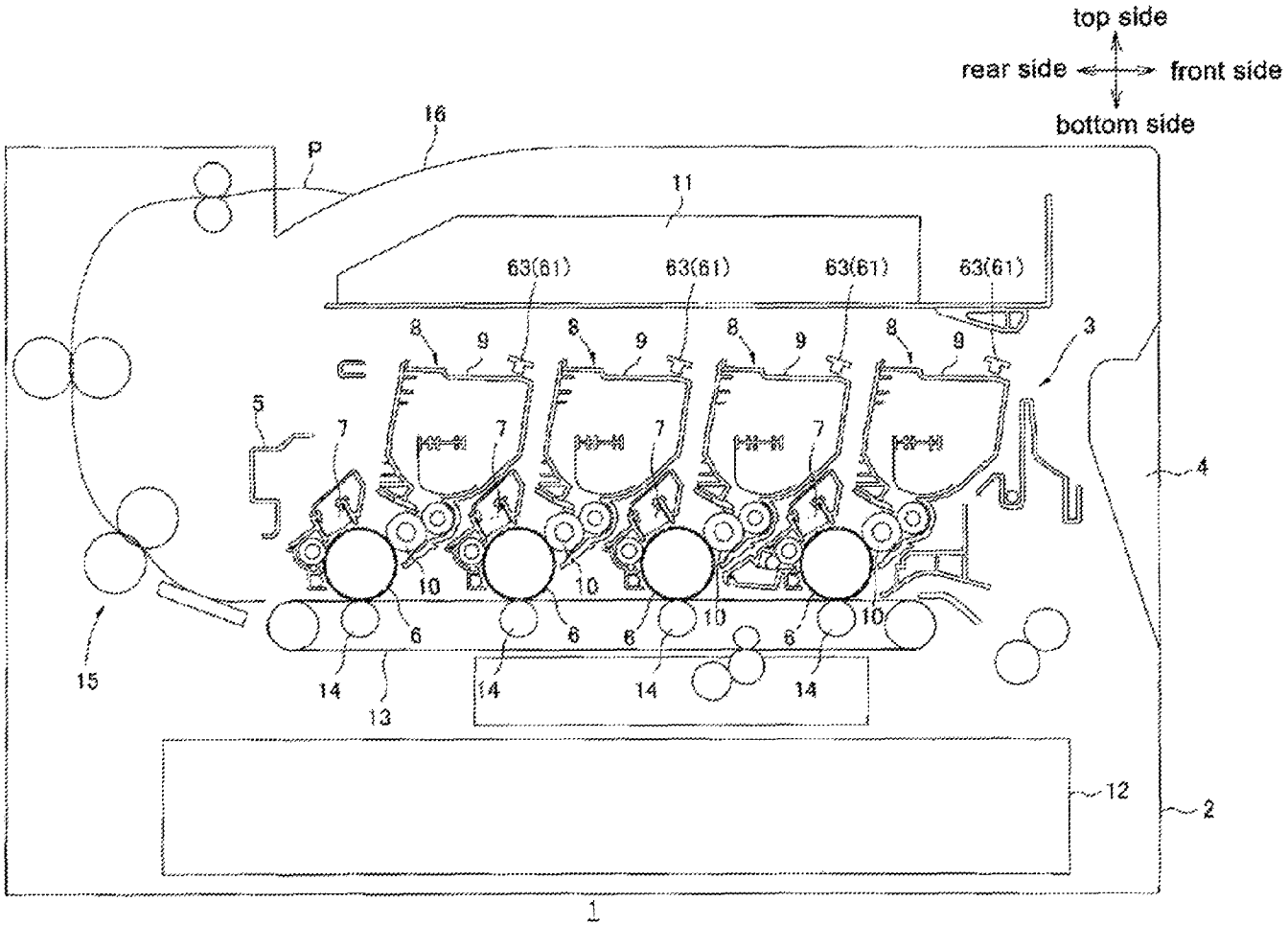
FIG. 1 is a cross-sectional view of a color printer including a drawer unit (developing cartridge) according to an exemplary embodiment of the present disclosure.

A color printer 1 shown in FIG. 1 is a tandem type color printer including a main body casing 2. A drawer unit 3 as an example of a process unit is provided in the main body casing 2. A front cover 4 is provided to be openable and closable on the front of the main body casing 2. The drawer unit 3 may move in a horizontal direction between a accommodated position in the main body casing 2 (a position shown in FIG. 1) and a drawn-out position of the outside of the main body casing 2 (a position shown in FIG. 8A), while the front cover 4 is opened.

Hereinafter, the front of the color printer 1 is a front side. Lip-down and left-right directions are defined by viewing each part (including the drawer unit 3) of the color printer 1 from the front side thereof.

The drawer unit 3 includes a rectangular frame-shaped drawer frame 5 when viewed from the top side.

A photosensitive drum 6 as an example of four photosensitive elements is rotatably held in drawer frame 5 about an axial line of rotation extending in a left-right direction. Four photosensitive drums 6 are provided for each color such as black, yellow, magenta, and cyan, respectively, and disposed in parallel in order of black, yellow, magenta, and cyan from the front with a regular space in a front-rear direction.

Four charging devices 7 are held in the drawer frame 5. Each of the four charging devices 7 are provided to correspond to photosensitive drum 6 and is disposed at the rear-upper side of the corresponding photosensitive drum 6. The charging device 7 is, for example, a scorotron type charging device including a wire and a grid.

The drawer unit 3 includes four developing cartridges 8 configured so as to be detachable to the drawer frame 5. The four developing cartridges 8 are provided to correspond to the photosensitive drums 6, respectively. Each developing cartridge 8 is mounted from upper side of the drawer frame 5 while the drawer unit 3 is drawn out to the drawn-out position and disposed at the front-upper side of the photosensitive drum 6. The drawer unit 3 with the developing cartridge 8 being separated from the drawer frame 5 is an example of the photosensitive unit.

Each developing cartridge 8 includes a case 9 and a developing roller 10 held in the case 9. The developing roller 10 is rotatably provided about an axial line of rotation extending in a left-right direction, and a part of the surface (circumferential surface) thereof is exposed from the case 9. While the developing cartridge 8 is mounted on the drawer frame 5, the surface of the developing roller 10 contacts the surface of the photosensitive drum 6 from a front-upper side thereof.

In the main body casing 2, an exposing device 11 emitting four laser beams corresponding to each color is disposed above the drawer unit 3.

According to the rotation of the photosensitive drum 6, the surface of the photosensitive drum 6 is uniformly charged by the discharge from the charging device 7 and then, selectively exposed by the laser beam from the exposing device 11. Charges on the surface of the photosensitive drum 6 are selectively removed by the exposure and an electrostatic latent image is formed on the surface of the photosensitive drum 6. When the electrostatic latent image faces the developing roller 10, a toner is supplied to the electrostatic latent image from the developing roller 10. Accordingly, a toner image is carried on the surface of the photosensitive drum 6.

Four LED arrays instead of the exposing device 11 may be provided to correspond to photosensitive drums 6, respectively.

A paper feeding cassette 12 receiving papers P is disposed at the bottom of the main body casing 2. Paper P received in the paper feeding cassette 12 is conveyed on a conveying belt 13 by various kinds of rollers. The conveying belt 13 is disposed to be opposite from the lower side of four photosensitive drums 6. Each of the transfer rollers 14 is disposed at each position opposite to the photosensitive drums 6 with the upper portion of the conveying belt 13 interposed therebetween. Papers P conveyed on conveying belt 13 pass through the conveying belt 13 and each photosensitive drum 6 in sequence, by traveling on the conveying belt 13. When the toner image on the surface of photosensitive drum 6 faces papers P between the photosensitive drum 6 and the transfer roller 14, the toner image is transferred to papers P.

A fixing unit 15 is provided at the downstream in a conveying direction of papers P with respect to the conveying belt 13. Papers P with the transferred toner image are conveyed to the fixing unit 15. The toner image is fixed to the papers P by heating and pressuring in the fixing unit 15. The papers P with the fixed toner image are discharged to a paper discharging tray 16 of the upper surface of the main body casing 2 by various kinds of rollers.

2. Drawer Unit (1) Drawer Frame

Figure 2:
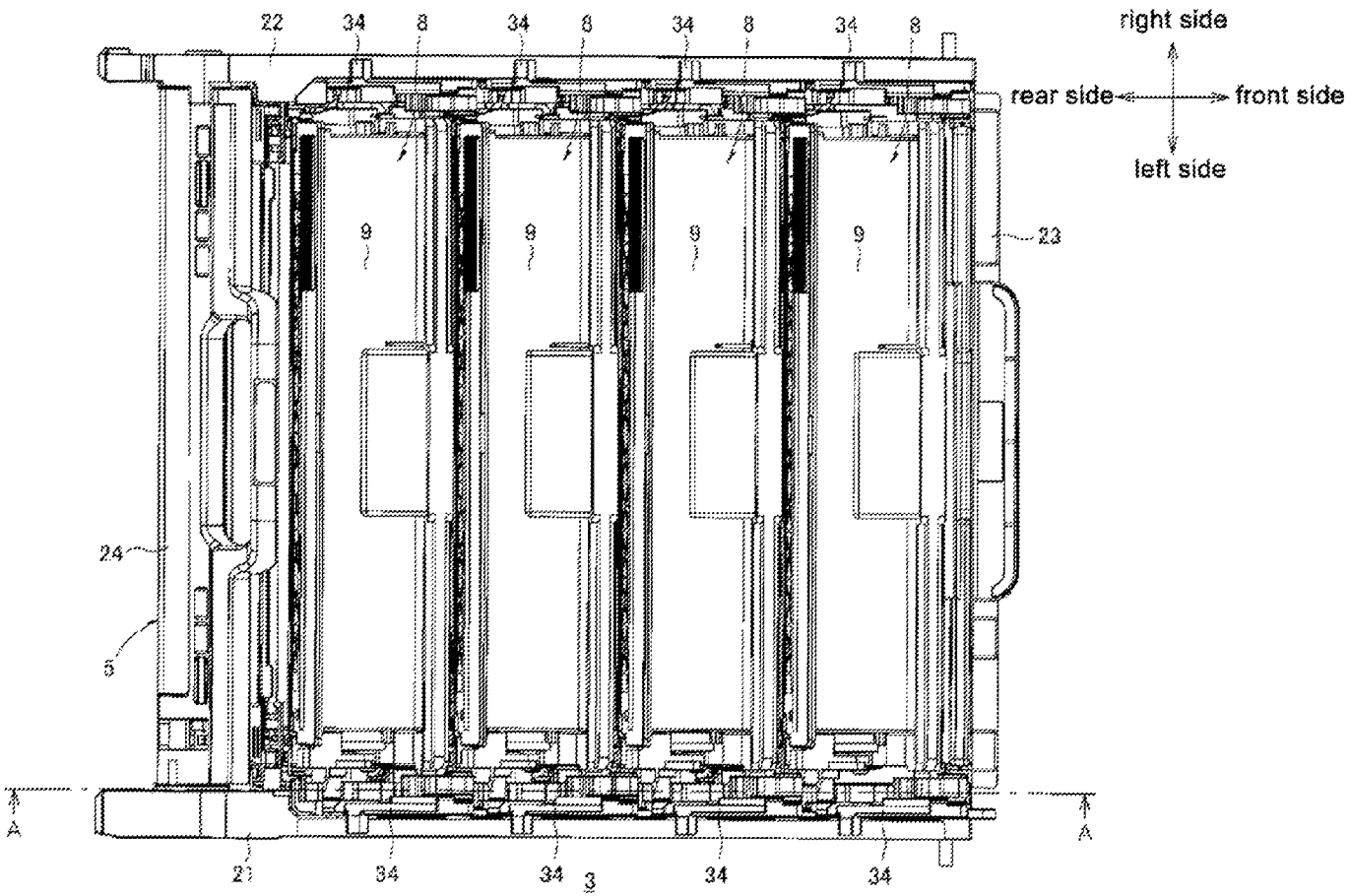
FIG. 2 is a plan view of the drawer unit shown in FIG. 1.

As shown in FIG. 2, the drawer frame 5 of the drawer unit 3 forms a rectangular frame when viewed from the top side. In detail, the drawer frame 5 includes a pair of side plates 21 and 22 facing each other with an interval in a left-right direction, a front beam 23 provided between the respective front ends of the pair of side plates 21 and 22, and a rear beam 24 provided between the respective rear ends of the pair of side plates 21 and 22.

Figure 3:
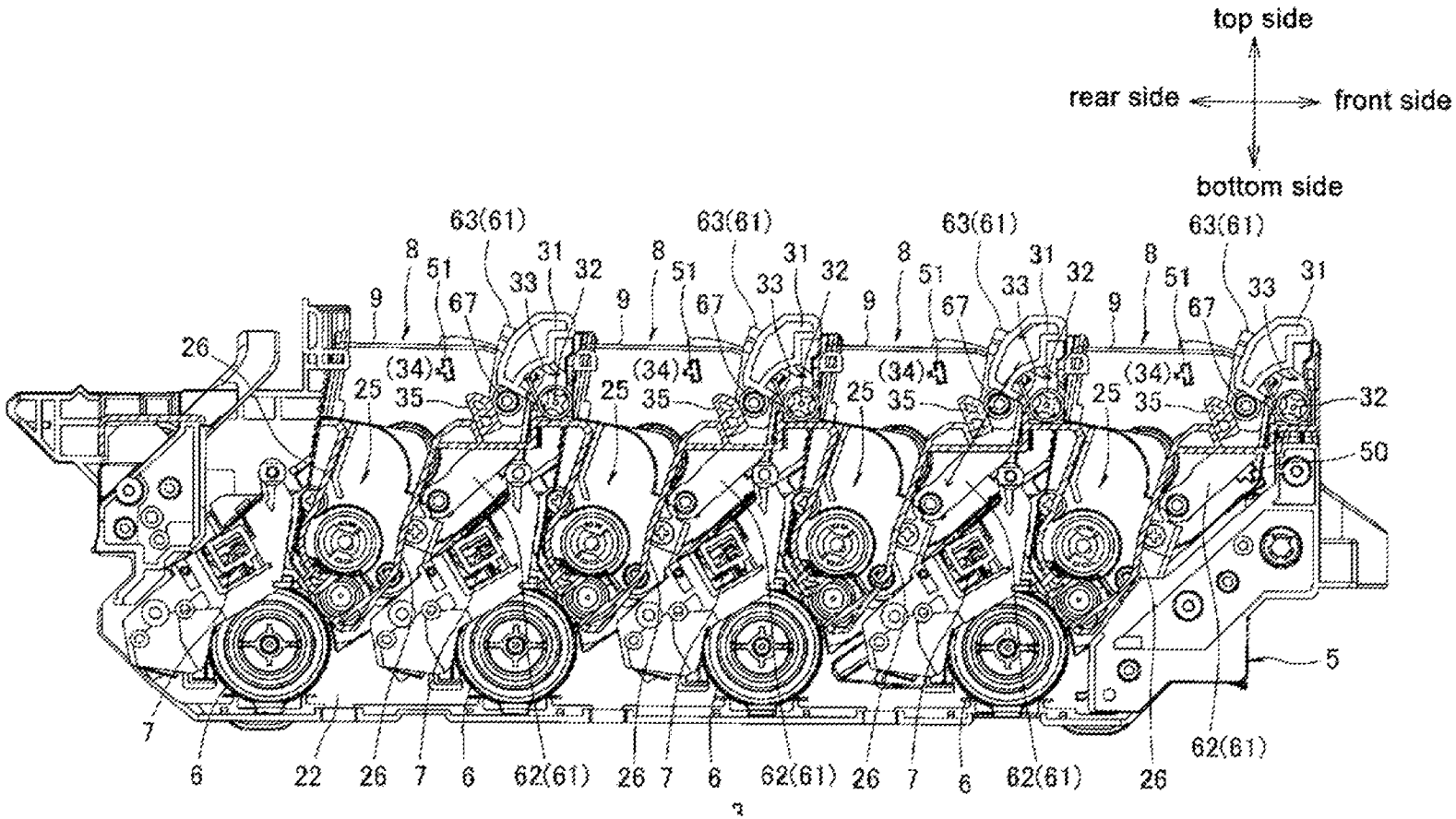
FIG. 3 is a cross-sectional view of the drawer unit taken along line A-A shown in FIG. 2.

As shown in FIG. 3, four photosensitive drums 6 are provided between lower ends of the pair of side plates 21 and 22. The four charging devices 7 are provided between the pair of side plates 21 and 22 at the rear-upper side of each photosensitive drum 6.

A space for mounting developing cartridge 8 is provided at a place defined by the front-upper side of each photosensitive drum 6 and the front side of each charging device 7 between the pair of side plates 21 and 22. The developing cartridge 8 is mounted on the space from the upper side thereof.

(2) Cartridge Guiding Part

Inside of each side plate 21 or 22, a cartridge guiding part 25 for guiding the attachment and detachment of developing cartridge 8 is formed on a position facing each space where four developing cartridges 8 are mounted. In detail, inside of each side plate 21 or 22, a protrusion 26 (a ribbed wall) protruding to the inside of the drawer frame 5 is formed. The protrusion 26 is formed in a substantially U shape opened upward at a position facing each space on which each developing cartridge 8 is mounted. Inside of the substantially U shaped portion of the protrusion 26 is formed as the cartridge guiding part 25.

The protrusion 26 is discontinued at the lower end of each portion forming the substantially U shape. A width of the discontinued portion is almost the same as an outer diameter of an axial cover 45 to be described below. In the discontinued portion, the protrusion 26 extends in parallel to a straight line connecting a rotational center of the photosensitive drum 6 with that of the developing roller 10 while the developing cartridge 8 is mounted on the drawer frame 5.

(3) Pressing Member

In each side plate 21 or 22, four pressing members 31 for pressing the developing cartridge 8 are provided to correspond to each space where four developing cartridges 8 are mounted. The pressing members 31 form a substantially fan-shaped plate in which the fan shape has a center angle of about 60 degrees when viewed from the side and a part of circumferential surface being cut from the fan shape.

In each side plate 21 or 22, four swing axes 32 are non-rotatably held. The swing axes 32 extend in a left-right direction at a position where a portion forming a center of the substantially fan shape of each pressing member 31 faces the left-right direction.

A front end of swing axes 32 is relatively rotatably penetrated into the portion forming a center of the substantially fan shape of each pressing member 31, such that the pressing member 31 is swingably (rotatably) supported by the swing axes 32 based on swing axes 32. A wire spring 33 is wound around the swing axes 32 and the pressing member 31 is biased in a counterclockwise direction by the wire spring 33 when viewed from the left side.

(4) Separating Member

Figure 4:
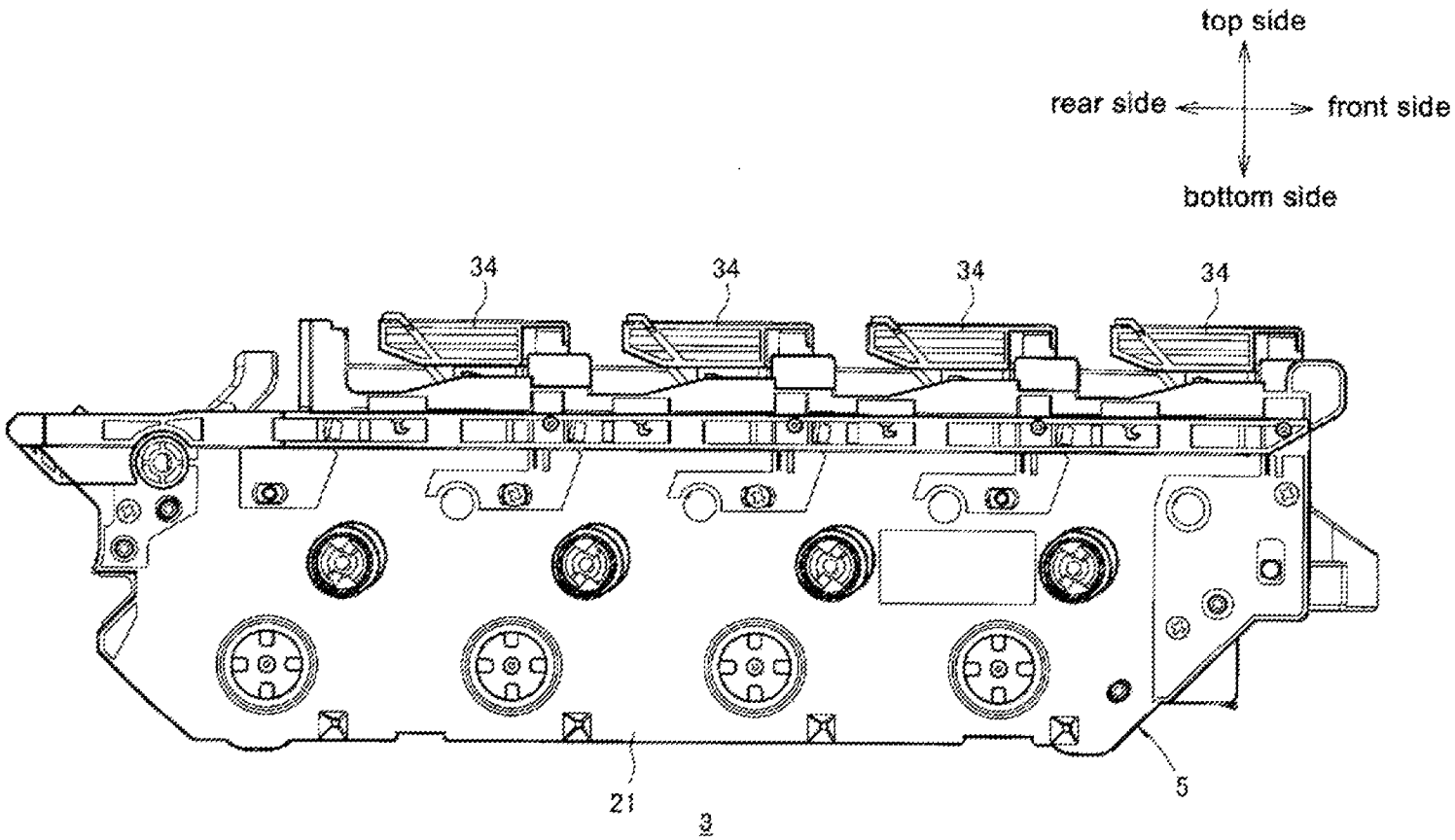
FIG. 4 is a left side view of the drawer unit shown in FIG. 1.
Figure 5A:
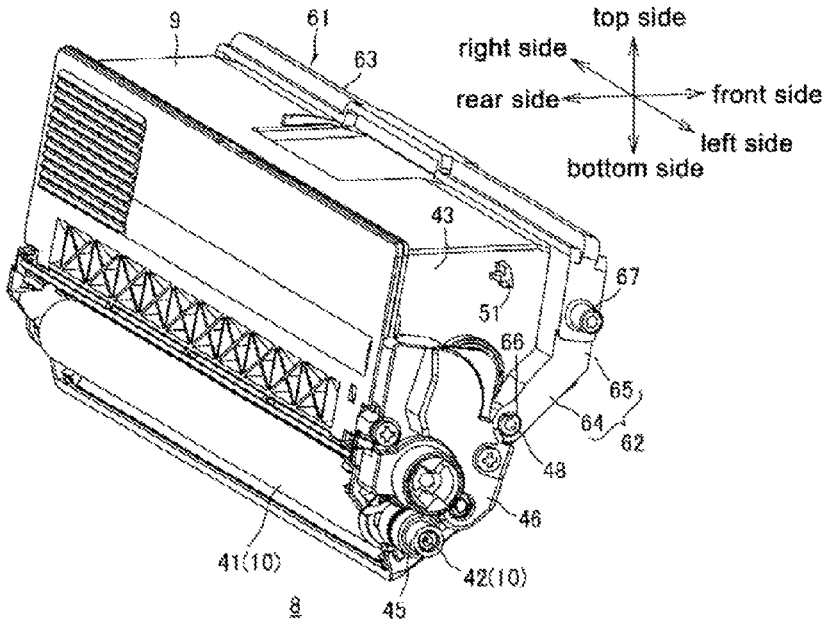
FIG. 5A is a perspective view of the developing cartridge shown in FIG. 3 viewed from the left-rear side, in which a swing member takes a first posture.
Figure 5B:
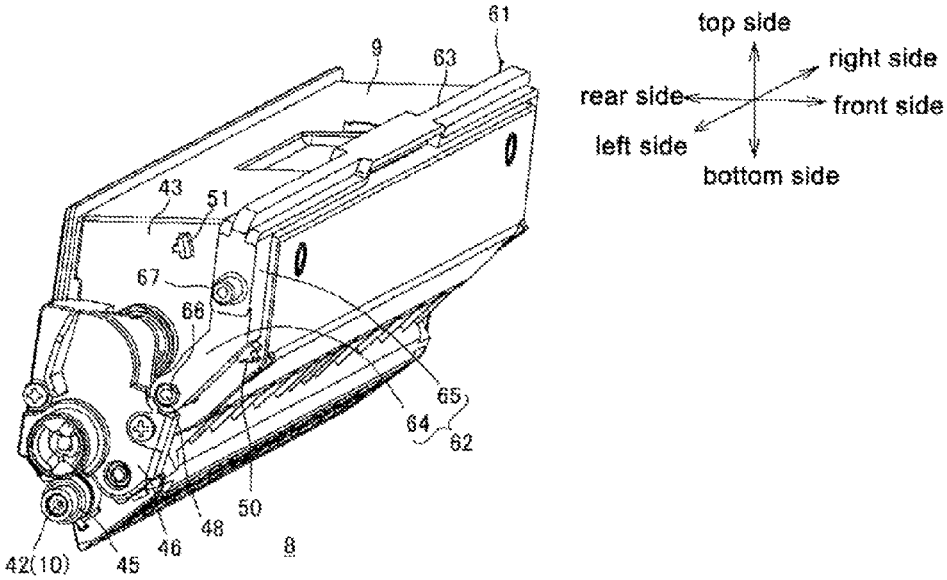
FIG. 5B is a perspective view of the developing cartridge shown in FIG. 3 viewed from the left-front side, in which a swing member takes a first posture.
Figure 5C:
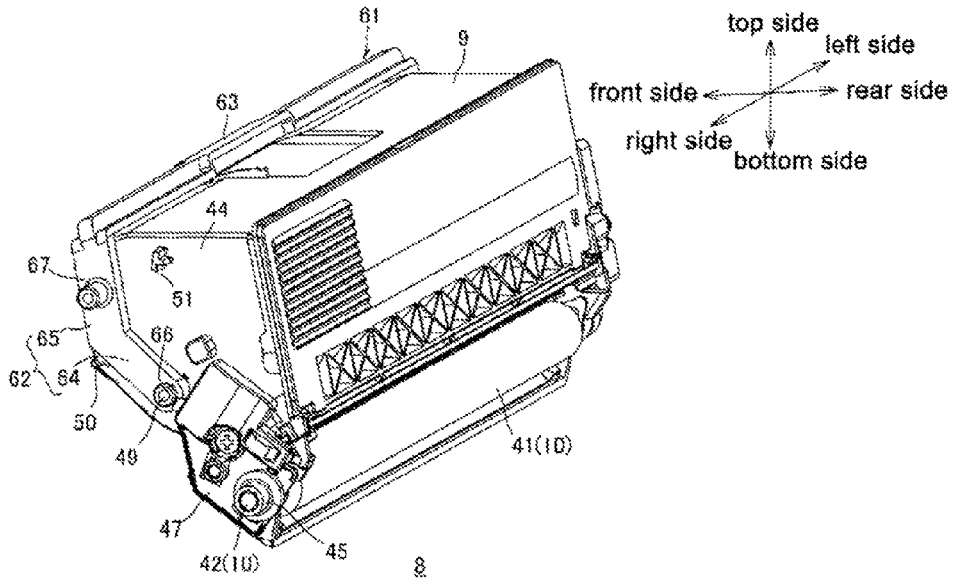
FIG. 5C is a perspective view of the developing cartridge shown in FIG. 3 viewed from a right-rear side, in which a swing member takes a first posture.
Figure 5D:
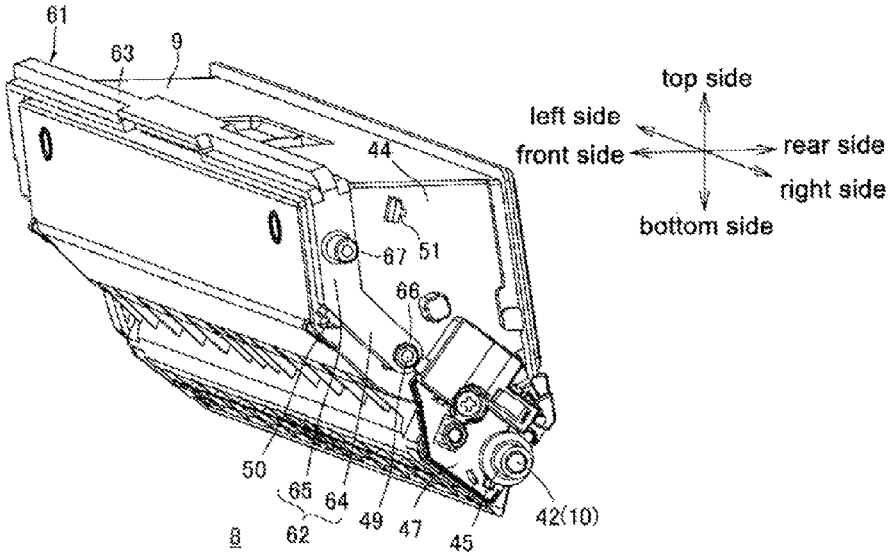
FIG. 5D is a perspective view of the developing cartridge shown in FIG. 3 viewed from the right-front side, in which a swing member takes a first posture.
Figure 6A:
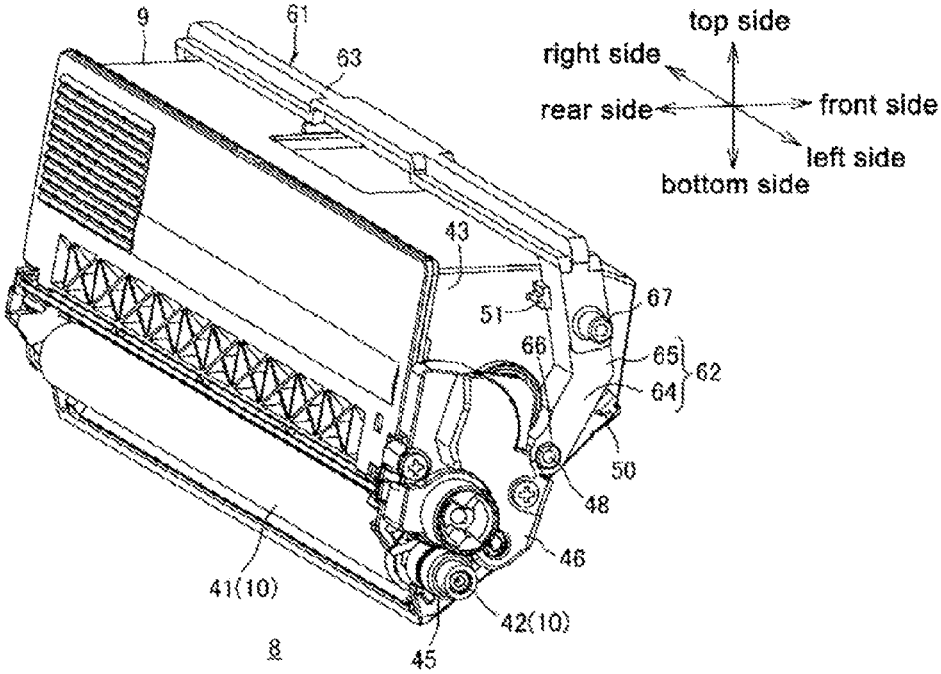
FIG. 6A is a perspective view of the developing cartridge shown in FIG. 3 viewed from the left-rear side, which a swing member takes a second posture.
Figure 6B:
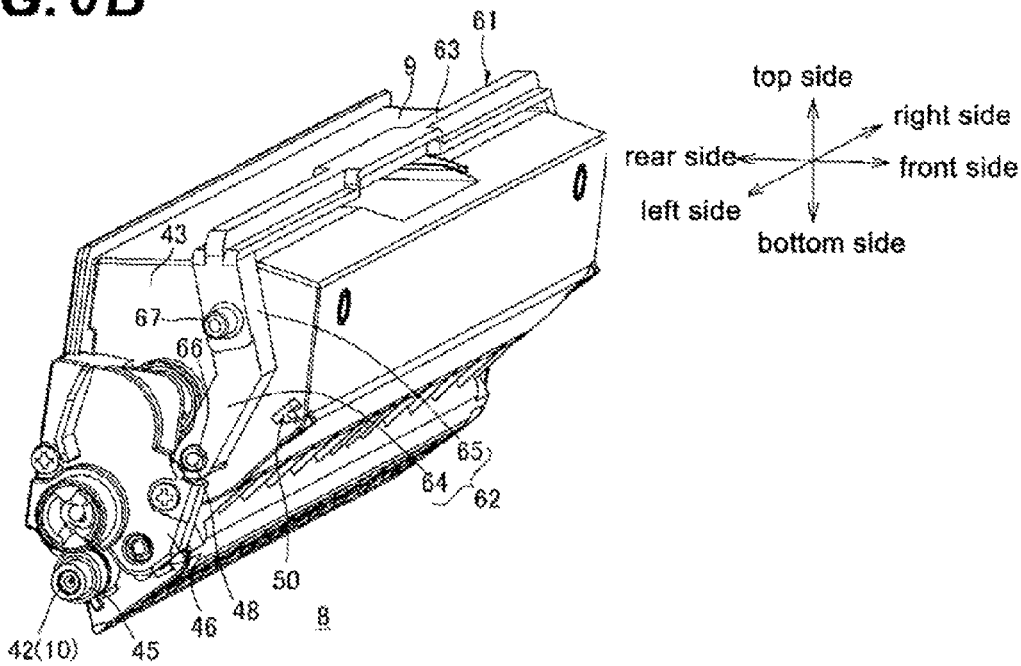
FIG. 6B is a perspective view of the developing cartridge shown in FIG. 3 viewed from the left-front side, in which a swing member takes a second posture.
Figure 6C:
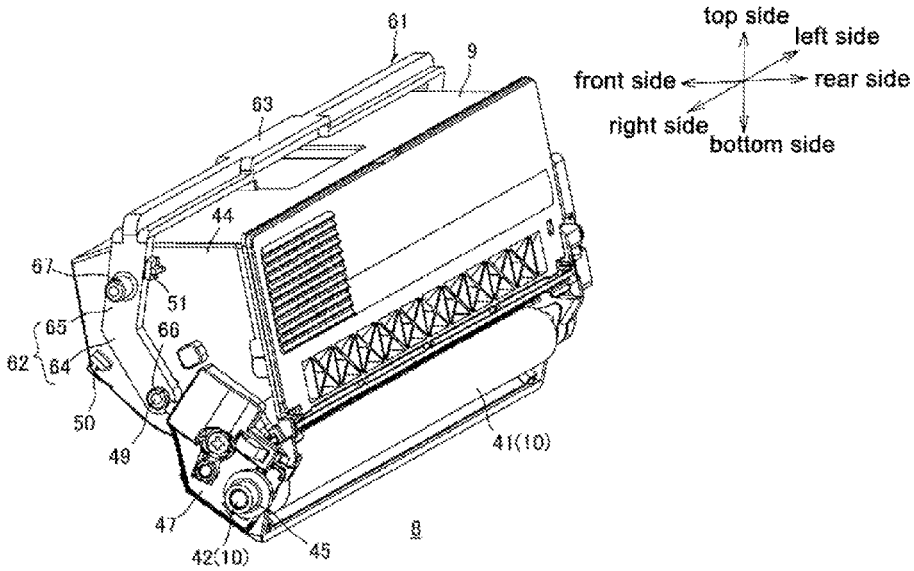
FIG. 6C is a perspective view of the developing cartridge shown in FIG. 3 viewed from the right-rear side, in which a swing member takes a second posture.
Figure 6D:
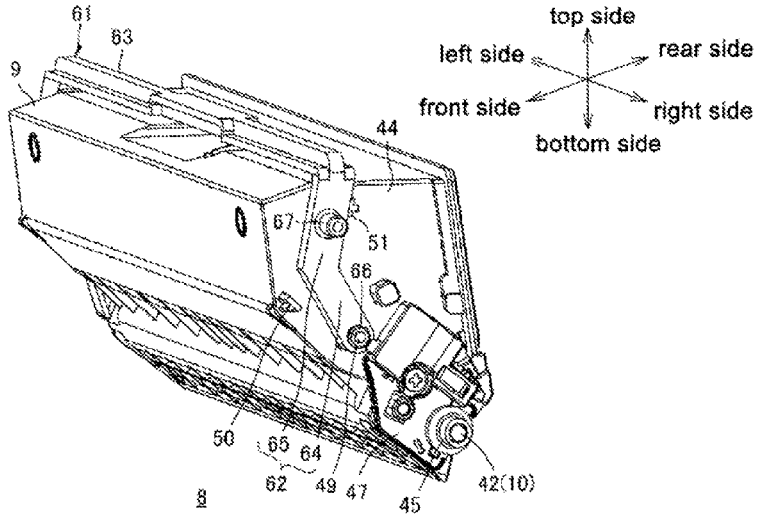
FIG. 6D is a perspective view of the developing cartridge shown in FIG. 3 viewed from the right-front side, in which a swing member takes a second posture.

As shown in FIG. 4, in each side plate 21 or 22, a separating member 34 for separating the developing roller 10 from the photosensitive drum 6 is provided at the outside of a left-right direction with respect to each pressing member 31. The separating member 34 forms a substantially right triangular plate shape when viewed from the side where a front-upper end thereof is an edge bent at a right angle and is biased in a clockwise direction by a wire spring (not shown) when viewed from the left side.

The separating member 34 includes an operating part 35 protruding toward the inside of the left-right direction at a position opposite from the rear-lower side with respect to the pressing member 31, as shown in FIG. 3.

3. Developing Cartridge (1) Case

As shown in FIGS. 5A, 5B, 5C, 5D, 6A, 6B, 6C, and 6D, the case 9 of developing cartridge 8 forms a substantially triangle tapered toward the lower end thereof when viewed from the side.

The developing roller 10 is rotatably held at the lower end of the case 9. The developing roller 10 includes a cylindrical roller main body 41 along an axial line extending in a left-right direction, and a developing roller shaft 42 penetrated into the roller main body 41 along the center axial line, as shown in FIGS. 5A, 5C, 6A, and 6C. Both ends of the developing roller shaft 42 protrudes from both cross-sections of right and left of the roller main body 41, pass through a left side wall 43 and a right side wall 44 of the case 9, and are rotatably held on the left side wall 43 and the right side wall 44. A shaft cover 45 is fitted on each of the both end of the developing roller shaft 42 protruding from the left side wall 43 and the right side wall 44.

As shown in FIGS. 5A, 5B, 6A, and 6B, a gear cover 46 is attached to the upper side of the shaft cover 45 in the lower end of the left side wall 43. A gear for transferring a driving force to the developing roller 10 and the like is accommodated in the gear cover 46. Meanwhile, as shown in FIGS. 5C, 5D, 6C, and 6D, an electrode cover 47 is attached to the lower end of the right side wall 44.

As shown in FIGS. 5A, 5B, 6A, and 6B, a cylindrical support shaft 48 extending in a left-right direction is provided to protrude from the left side wall 43 at the upper side of the gear cover 46 and the center of the front end in a up-down direction. Meanwhile, as shown in FIGS. 5C, 5D, 6C, and 6D, a support shaft 49 is provided to protrude from the right side wall 44 at a position at which the central axial line is shared with support shaft 48. End surfaces of the outside of the left-right direction of support shafts 48 and 49 are disposed at further inside than an end surface of the outside of a left-right direction of a pressed part 67 to be described below.

As shown in FIGS. 5A to 6D, stoppers 50 are formed to protrude from the left side wall 43 and right side wall 44, respectively at a position separated from the front-upper side of the support shafts 48 and 49. Stoppers 51 are formed to protrude from the left side wall 43 and right side wall 44, respectively, at the center of the left-right direction of the front end.

(2) Swing Member

The developing cartridge 8A is provided with a swing member 61 swingably supported by the shafts 48 and 49. The swing member 61 includes a pair of arms 62 and a connecting part 63 connecting the pair of arms 62.

The right and left arms 62 are disposed at the outside of the case 9 and extend along the left side wall 43 and right side wall 44 between two stoppers 50 and 51, respectively. Specifically, the right and left arms 62 integrally include a first portion 64 which extends toward the front upper side from each support shaft 48 or 49 and a second portion 65 bent toward the rearward from the front end of first portion 64 to extend up to a position beyond the upper surface of the case 9.

A through-hole 66 is formed to pass through the lower end of the first portion 64 in a left-right direction. The support shafts 48 and 49 are penetrated to (loose fitted to) the through-hole 66 while maintaining a sufficient clearance, such that the right and left arms 62 are swingably supported by the support shafts 48 and 49, respectively.

A cylindrical pressed part 67 is provided to protrude in the left-right direction from the center of the second portion 65 in a longitudinal direction. The pressed part 67 is integrally formed with the second portion 65.

A connecting part 63 is provided between front ends of the second portion 65 of the right and left arms 62 at the upper side of the case 9. The connecting part 63 is integrally formed with arms 62.

4. Pressing and Separating of Developing Roller

As shown in FIG. 3, the shaft cover 45 is disposed at the lower end of the cartridge guiding part 25 (the discontinued portion of the protrusion 26) while developing cartridge 8 is mounted on the drawer frame 5. When the first portion 64 of the swing member 61 contacts the stopper 50, the swing member 61 takes a first posture and the pressed part 67 of the swing member 61 is engaged between the pressing member 31 and the operating part 35 of the separating member 34. Accordingly, the pressed part 67 receives a pressing force from the pressing member 31 toward the rear-lower side, and the pressing force is transferred to the support shafts 48 and 49 through the swing member 61, such that the support shafts 48 and 49 are pressed to the rear lower side, and the roller main body 41 of the developing roller 10 is pressed to the photosensitive drum 6.

The color printer 1 includes a color mode forming a color image on papers P as an operational mode and a monochrome mode forming a monochrome image on papers P. In the color mode, the developing roller 10 is pressure-abutted to all the photosensitive drums 6. In the monochrome mode, the developing roller 10 is pressure-abutted to only the photosensitive drum 6 for black and the developing roller 10 is separated from the photosensitive drums 6 for yellow, magenta, and cyan.

When the developing roller 10 is separated from the photosensitive drums 6, a direct operating cam (not shown) provided in the main body casing 2 moves in a front-rear direction to push down the rear end of separating member 34. Accordingly, the separating member 34 is rotated in a counterclockwise direction when viewed from the left side, such that the operating part 35 of the separating member 34 pushes up pressed part 67 front-upward and developing cartridge 8 moves upward. As a result, the developing roller 10 is separated from the photosensitive drum 6.

5. Attachment and Detachment of Developing Cartridge

The attachment and detachment of the developing cartridge 8 to the drawer frame 5 are performed in the state where the drawer frame 5 (drawer unit 3) is drawn out at the drawn-out position outside of the main body casing 2.

Figure 7A:
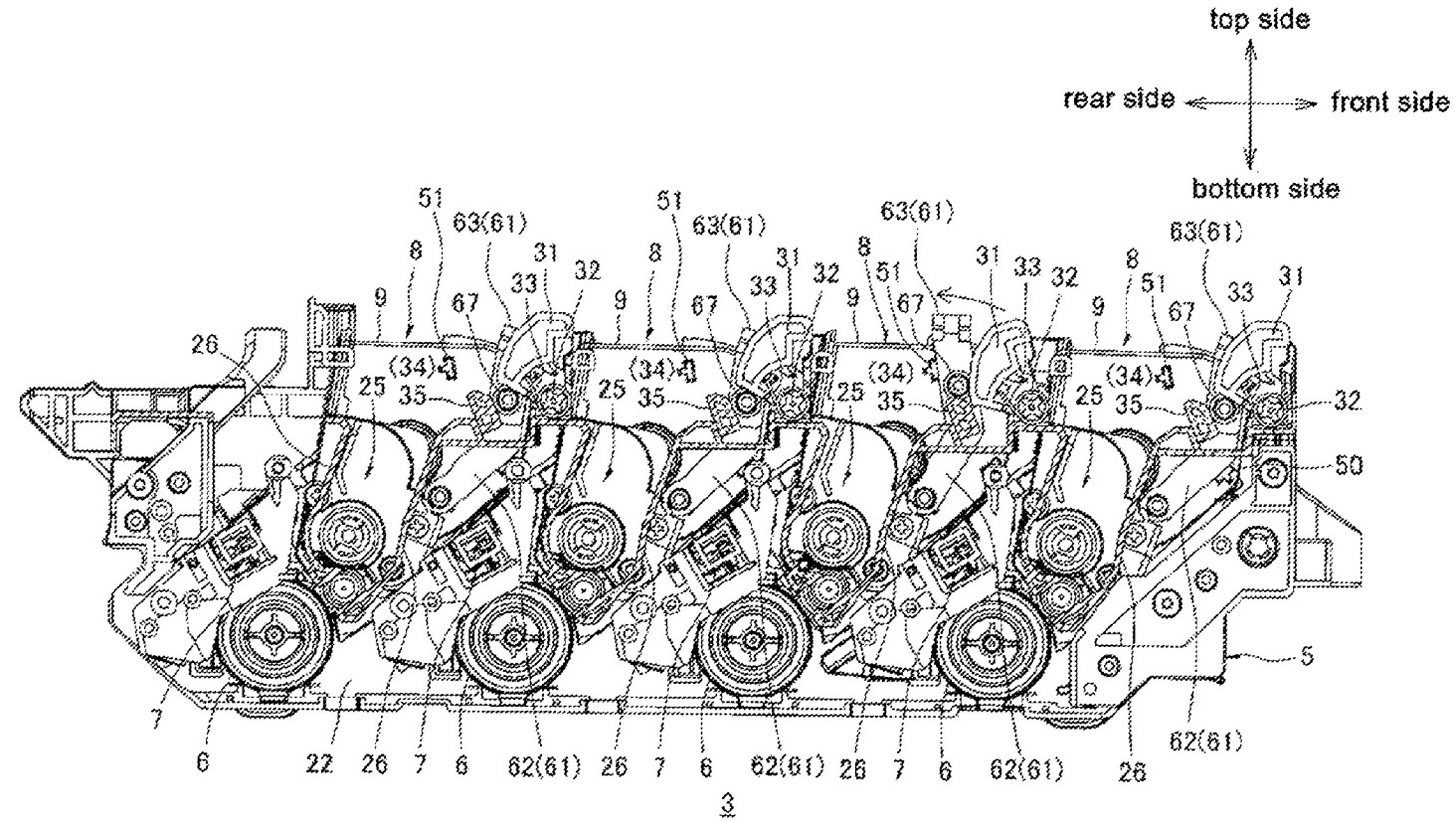
FIG. 7A is a cross-sectional view of the drawer unit taken along line shown in FIG. 2, in which a swing member takes a second posture.

When the developing cartridge 8 is removed from the drawer frame 5, a user grabs the connecting part 63 of the swing member 61 to erect that swing member 61 toward the rear side. Accordingly, as shown in FIG. 7A, the swing member 61 is rotated in a counterclockwise direction when viewed from the left side and the pressed part 67 gets out from between the pressing member 31 and the operating part 35 of the separating member 34. When the second portion 65 of the arms 62 contacts the stopper 51, the swing member 61 is prevented from being rotated any more, such that the swing member 61 takes a second posture.

Figure 7B:
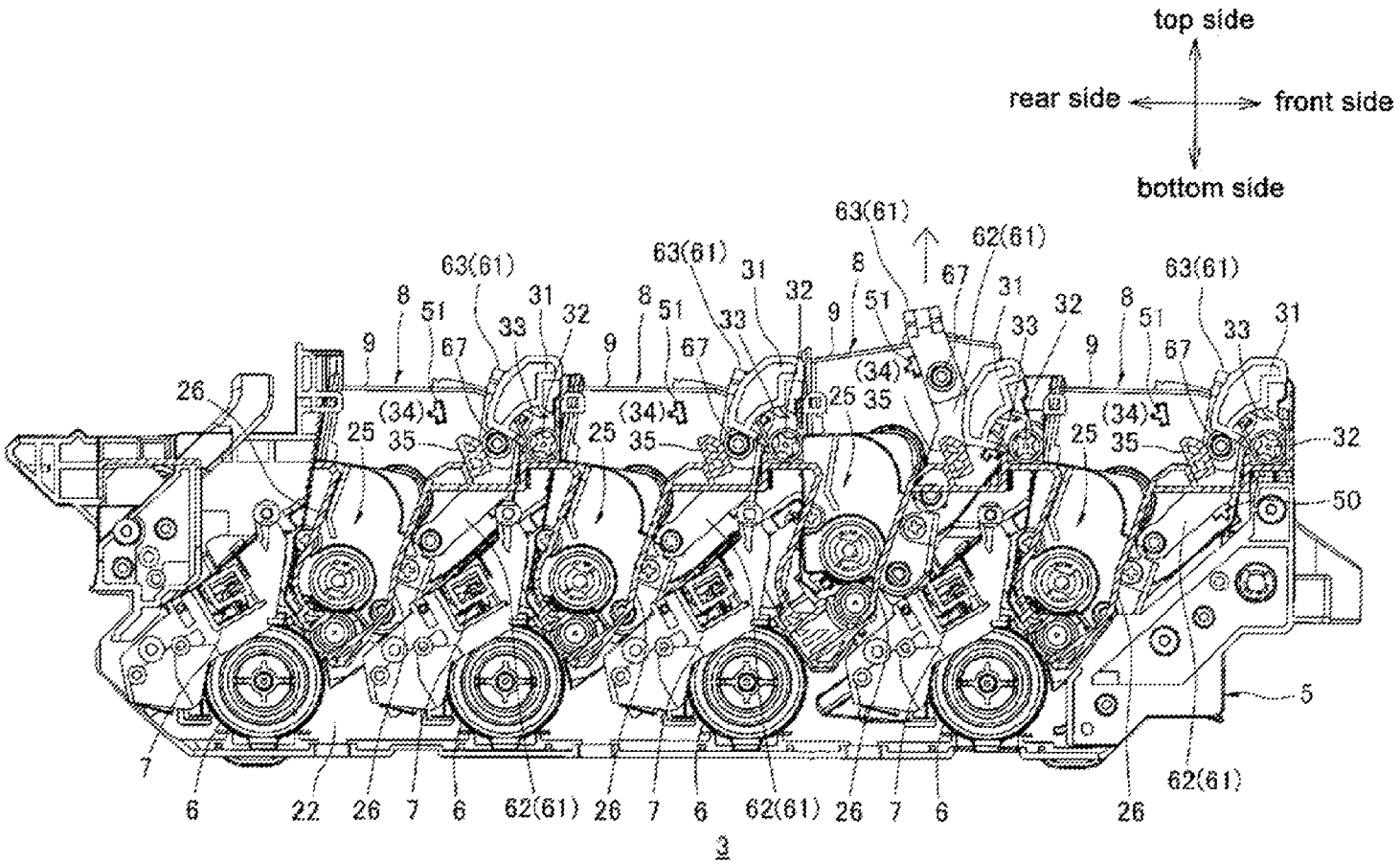
FIG. 7B is a cross-sectional view of the drawer unit taken along line A-A shown in FIG. 2, in which a developing cartridge is slightly pulled upward from a drawer frame.

Thereafter, as shown in FIG. 7B, the connecting part 63 of the swing member 61 is pulled upward. Accordingly, while the shaft cover 45 is guided to the cartridge guiding part 25 and specifically, the shaft cover 45 moves along the portion formed at the front of the cartridge guiding part 25 from the protrusion 26, the developing cartridge 8 moves upward.

Figure 7C:
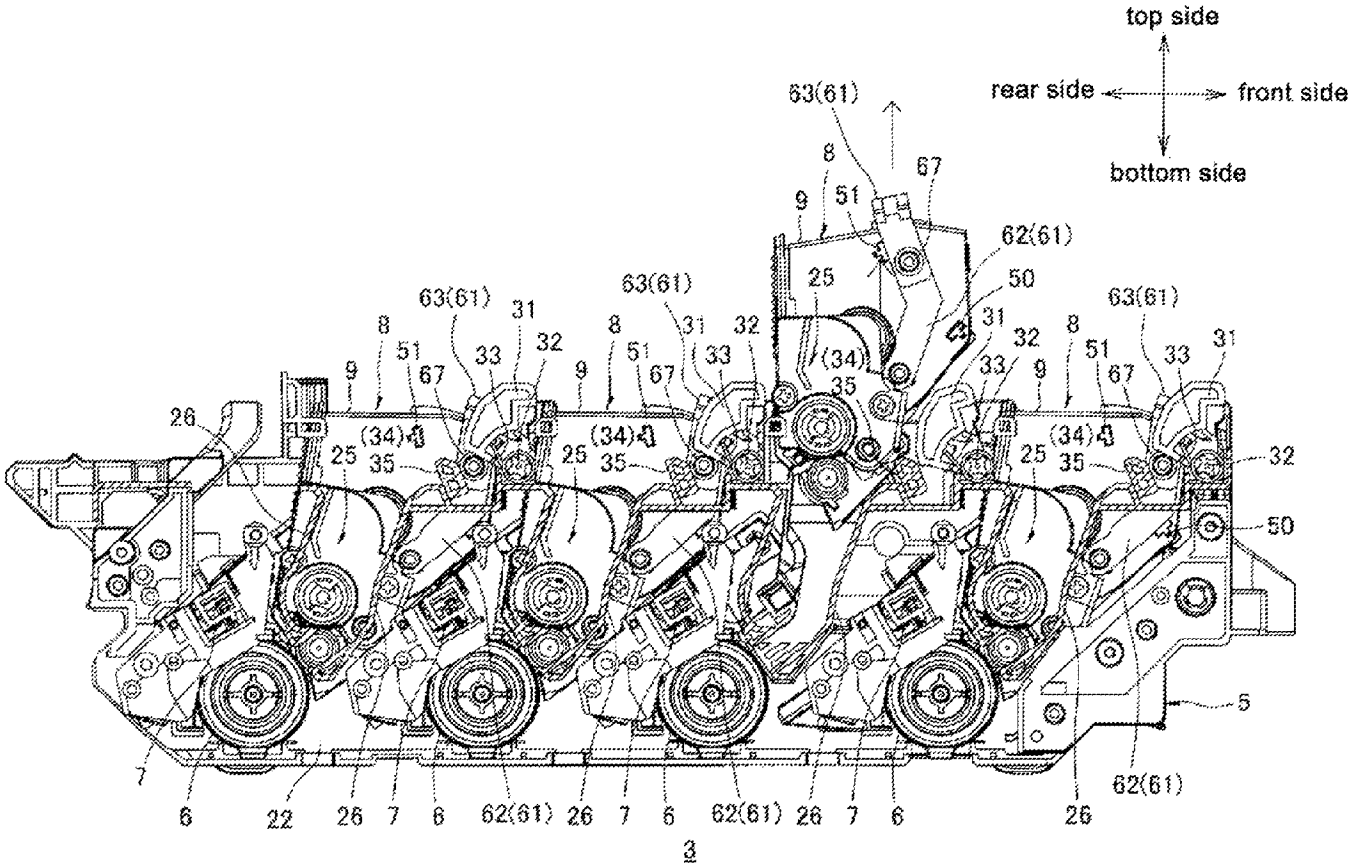
FIG. 7C is a cross-sectional view of the drawer unit taken along line A-A shown in FIG. 2, in which the developing cartridge is further pulled upward in the state shown in FIG. 7B.

As shown in FIG. 7C, when the developing cartridge 8 continues to move upward and the shaft cover 45 is separated from the protrusion 26, the developing cartridge 8 is removed from the drawer frame 5. When the developing cartridge 8 is removed from the drawer frame 5, the user grabs the connecting part 63 of the swing member 61 to transport the developing cartridge 8. In this case, the connecting part 63 acts as a handle for handling the developing cartridge 8.

When the developing cartridge 8 is mounted on the drawer frame 5, the developing cartridge 8 is disposed above the drawer frame 5 and the developing cartridge 8 moves toward the photosensitive drum 6 while the developing roller 10 heads toward the lower side. During the movement, the shaft cover 45 is inserted to the cartridge guiding part 25 from the upper side thereof. Thereafter, according to the movement of the developing cartridge 8, the shaft cover 45 is guided to the cartridge guiding part 25 and the developing roller 10 moves in a direction close to the photosensitive drum 6. When the shaft cover 45 reaches the lower end of the cartridge guiding part 25, the roller main body 41 of the developing roller 10 contacts the photosensitive drum 6.

Thereafter, the user grabs the connecting part 63 of the swing member 61 to push down the swing member 61 toward the front side. Accordingly, the swing member 61 is rotated in a clockwise direction when viewed from the left side and pressed part 67 enters into between the pressing member 31 and the operating part 35 of the separating member 34 while pressed part 67 pushes up the pressing member 31. When the first portion 64 of the arms 62 contacts the stopper 50, the swing member 61 is prevented from being rotated any more, such that the swing member 61 takes the first posture. Accordingly, the mounting of the developing cartridge 8 on the drawer frame 5 is completed.

6. Compulsory Displacement from Second Posture to First Posture of Swing Member

While the swing member 61 is not displaced from the second posture to the first posture and the developing cartridge 8 is not completely mounted on the drawer frame 5, there is a concern that the drawer frame 5 is restored from the drawn-out position to the accommodated position in the main body casing 2.

Figure 8A:
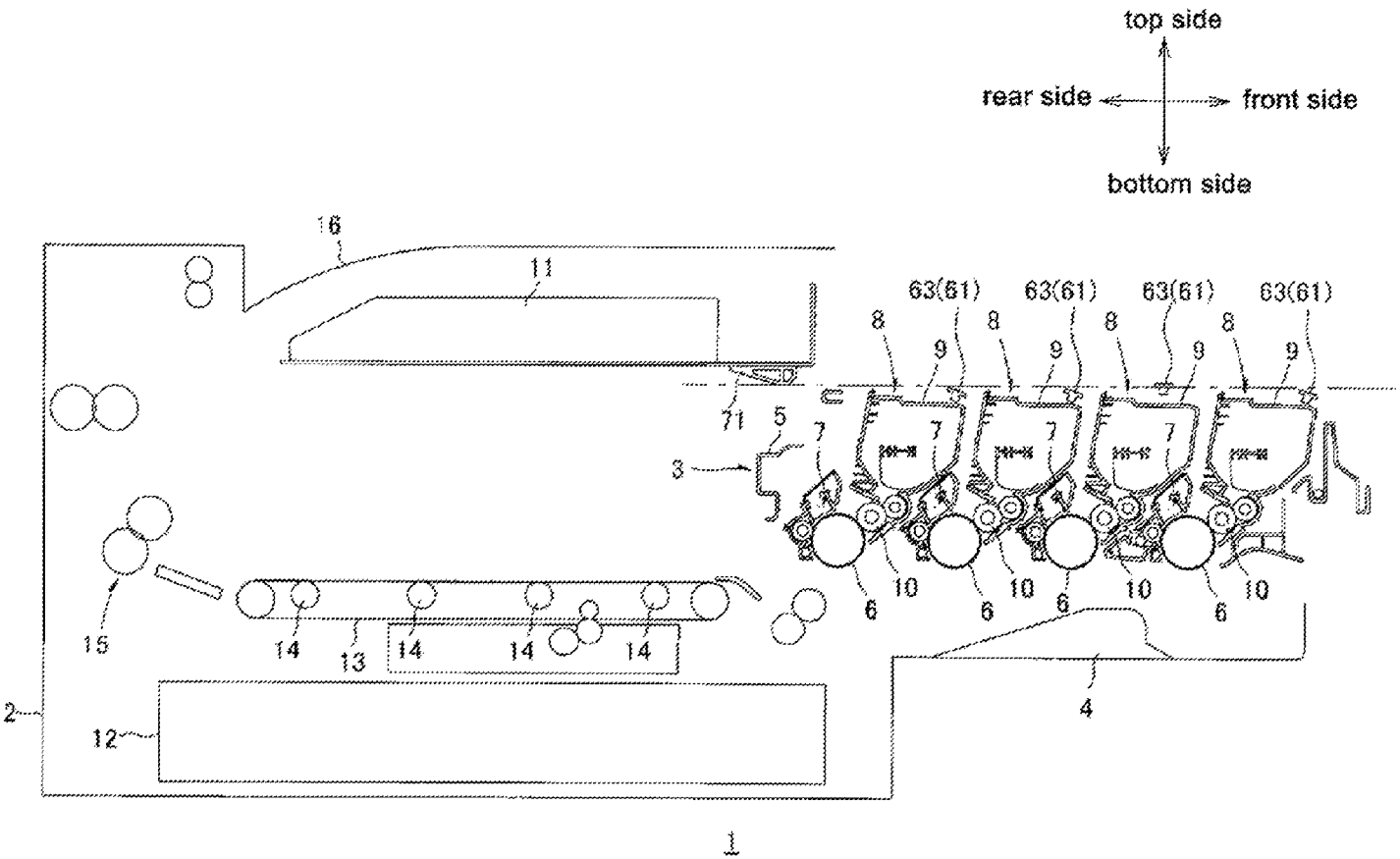
FIG. 8A is a cross-sectional view of the color printer shown in FIG. 1, in which a drawer unit is in the state disposed at a drawn-out position.

Accordingly, as shown in FIG. 8A, a contacting part 71 is provided around the front cover 4 in the main body casing 2. The contacting part 71 is fixed, for example, to the bottom of a support plate 72 supporting the exposing device 11. The contacting part 71 overlaps the connecting part 63 of the swing member 61 in the second posture in a front-rear direction (horizontal direction) and does not overlap the connecting part 63 of the swing member 61 in the first posture in a horizontal direction.

Figure 8B:
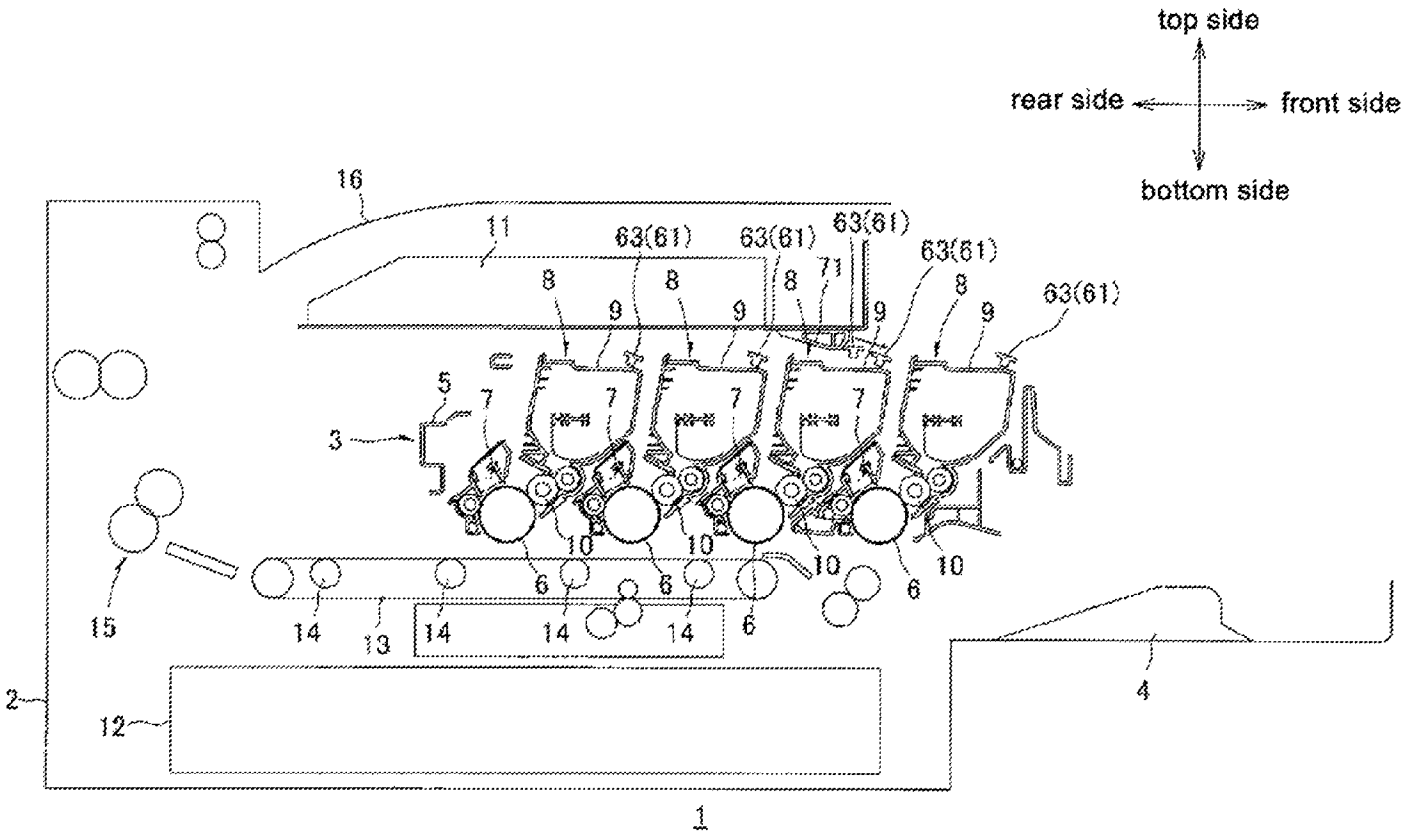
FIG. 8B is a cross-sectional view of the color printer shown in FIG. 1, in which a drawer unit is in the state while moving from the drawn-out position to a accommodated position and a swing member is displaced from the second posture to the first posture.

As shown in FIG. 8B, while the swing member 61 is not displaced from the second posture to the first posture and the drawer frame 5 moves toward the accommodated position from drawn-out position, the connecting part 63 of the swing member 61 in the second posture contacts the contacting part 71 on the way the drawer frame 5 moves. Thereafter, when the drawer frame 5 further moves, the connecting part 63 is pushed toward the front side by the contacting part 71. Accordingly, the swing member 61 is displaced from the first posture to the second posture.

Figure 8C:
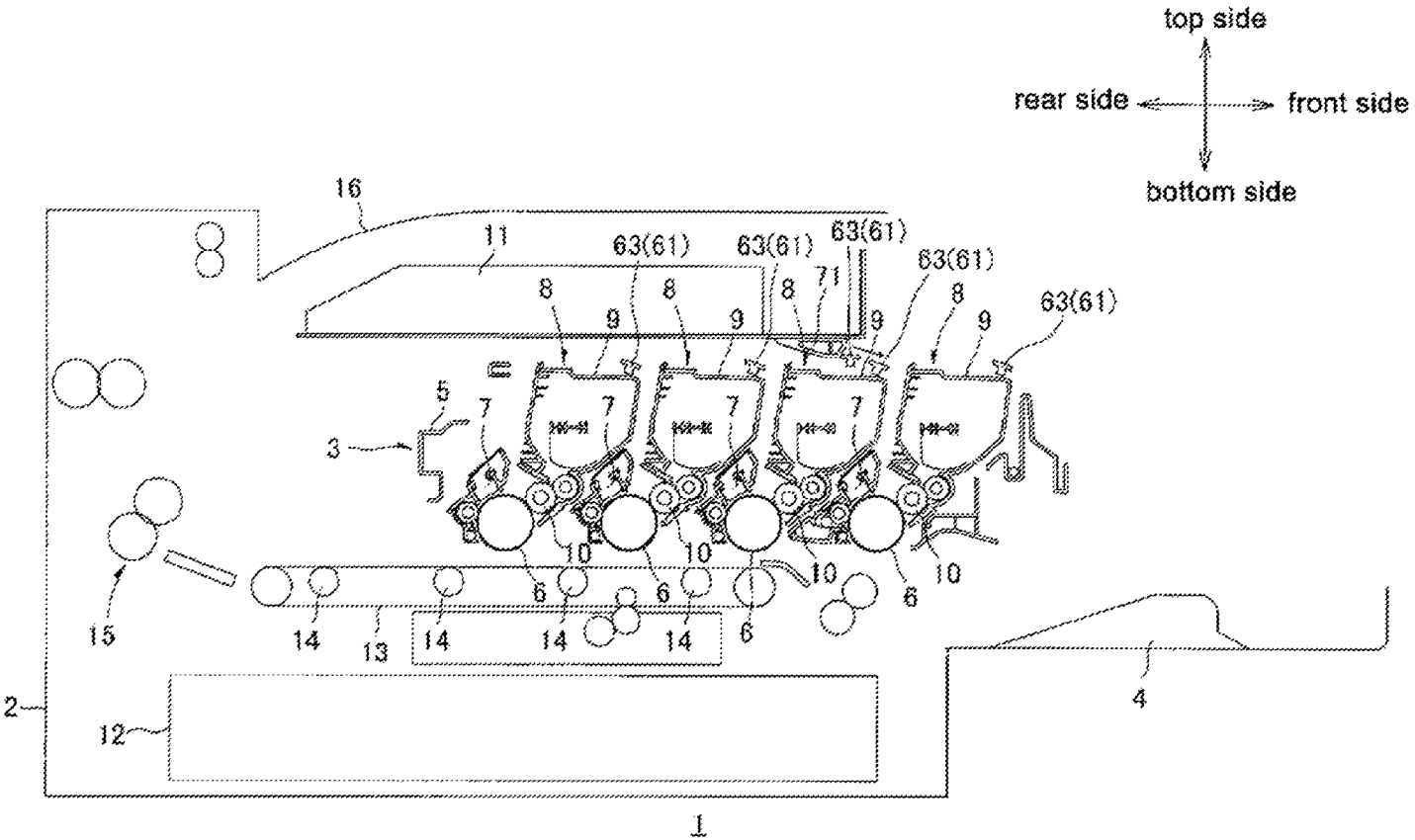
FIG. 8C is a cross-sectional view of the color printer shown in FIG. 1, in which a drawer unit is disposed at a accommodated position and a front cover is open.

Therefore, as shown in FIG. 8C, while the drawer frame 5 is disposed at the accommodated position, the swing member 61 of all the developing cartridges 8 takes the first posture.

7. Effect (1) Effect 1

As described above, the developing cartridge 8 is detachable from drawer unit 3 (drawer frame 5) including the photosensitive drum 6 and the pressing member 31. The developing roller 10 is rotatably supported to the case 9 of the developing cartridge 8. The case 9 includes a pair of the left side wall 43 and right side wall 44 facing each other in a left-right direction that is the axial direction of the developing roller 10.

The swing member 61 is provided at the outside of the case 9. The swing member 61 includes the pair of the arms 62 extending along the left side wall 43 and the right side wall 44, and the pressed part 67 extending to the outside of a left-right direction from each arm 62. The swing member 61 is provided so as to swing about the axial line extending in the left-right direction between the first posture and the second posture. While the swing member 61 is in the first posture, pressed part 67 is pressed by the pressing member 31. If the swing member 61 is displaced from the first posture to the second posture, the pressed part 67 is released from being pressed by the pressing member 31.

Since the pressed part 67 is provided to the swing member 61 which is a separate member from the case 9, the position of pressed part 61 is free from restraint on a layout of another member disposed at the left side wall 43 and right side wall 44 of the case 9. Accordingly, the degree of freedom position of pressed part 67 can be increased.

Although pressed part 67 is repetitively pressed by the pressing member 31 and is broken, if the swing member 61 is replaced with a new product, the developing cartridge 8 can be continuously used. Accordingly, the developing cartridge 8 can be used over a long period of time.

(2) Effect 2

A pair of arms 62 is connected to each other by the connecting part 63. Accordingly, the pair of arms 62 can be swung at the same time.

(3) Effect 3

The connecting part 63 also acts as a handle. Accordingly, the number of components is not increased and operability in conveying the developing cartridge 8 can be improved.

(4) Effect 4

The connecting part 63 is integrally formed with the arms 62. As a result, the arms 62 need not to be connected to the connecting part 63 during the manufacturing of the developing cartridge 8. Accordingly, the time required for the manufacturing of the developing cartridge 8 can be reduced.

(5) Effect 5

The support shafts 48 and 49 extending in a left-right direction are provided between the left side wall 43 and right side wall 44, and the arms 62 extending along the left side wall 43 and right side wall 44, respectively. The swing member 61 can be swung in the first posture and the second posture based on the support shafts 48 and 49.

(6) Effect 6

One end of the support shafts 48 and 49 are fixed to the left side wail 43 and the right side wall 44 of the case 9. Meanwhile, the other ends of the support shafts 48 and 49 are inserted into and loosely fitted to the through-hole 66 formed at the arms 62. As a result, the support shafts 48 and 49 can be pulled out from the through-hole 66, such that swing member 61 can be easily detached from the case 9. The support shafts 48 and 49 can be penetrated into the through-hole 66, such that swing member 61 can be easily attached to the case 9. Accordingly, when pressed part 67 is broken, the swing member 61 can be simply replaced with a new product.

(7) Effect 7

End surfaces of the outside of the support shafts 48 and 49 in the left-right direction are disposed at further inside in a left-right direction as compared with an end surface of the outside of the pressed part 67 in a left-right direction. Accordingly, when the developing cartridge 8 is attached to and detached from drawer unit 3, the support shafts 48 and 49 can be prevented from being disturbed.

(8) Effect 8

The pressed part 67 is integrally formed with the arms 62. As a result, the pressed part 67 needs not to be attached to the arms 62 during the manufacturing of the developing cartridge 8. Accordingly, the time required for the manufacturing of the developing cartridge 8 can be reduced.

(9) Effect 9

The arms 62 extend in a diameter direction of the developing roller 10 and include first portion 64 swingably connected to the left side wail 43 and the right side wall 44 at one end thereof and the second portion 65 extending to the rear, which is a downstream of a direction from the first posture toward the second posture with respect to an extended line along the first portion 64, from the other end of the first portion 64. Although the swing member 61 takes any of the first posture and the second posture, connecting part 63 is disposed above the case 9. As a result, since the connecting part 63 can be easily grabbed, the swing member 61 can be easily swung in the first posture and the second posture by grabbing the connecting part 63.

8. Modified Example (1) First Modified Example

Figure 9:
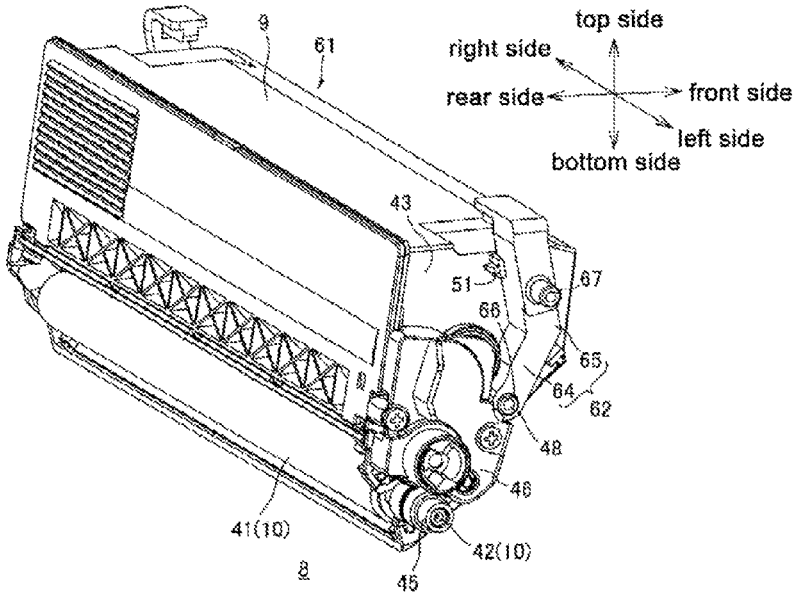
FIG. 9 is a perspective view of a developing cartridge according to a first modified example (a form in which a connecting part is omitted) viewed from the left-rear thereof.

As shown in FIG. 9, the swing member 61 may not include the connecting part 63. In this configuration, in order to displace the swing member 61 between the first posture and the second posture, both sides of two arms 62 separated from each other need to be swung.

(2) Second Modified Example

Figure 10A:
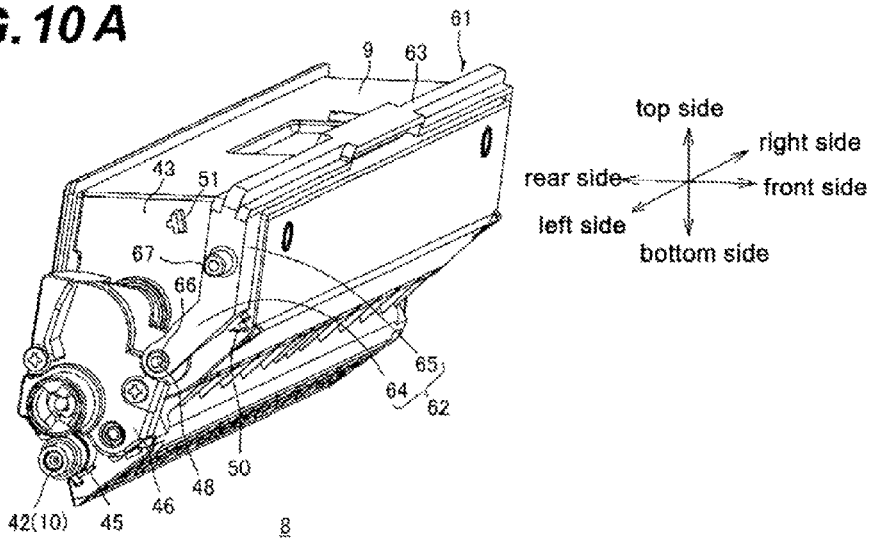
FIG. 10A is a perspective view of a developing cartridge according to a second modified example (a form in which a support axis is provided in a gear cover) viewed from the left-front thereof.
Figure 10B:
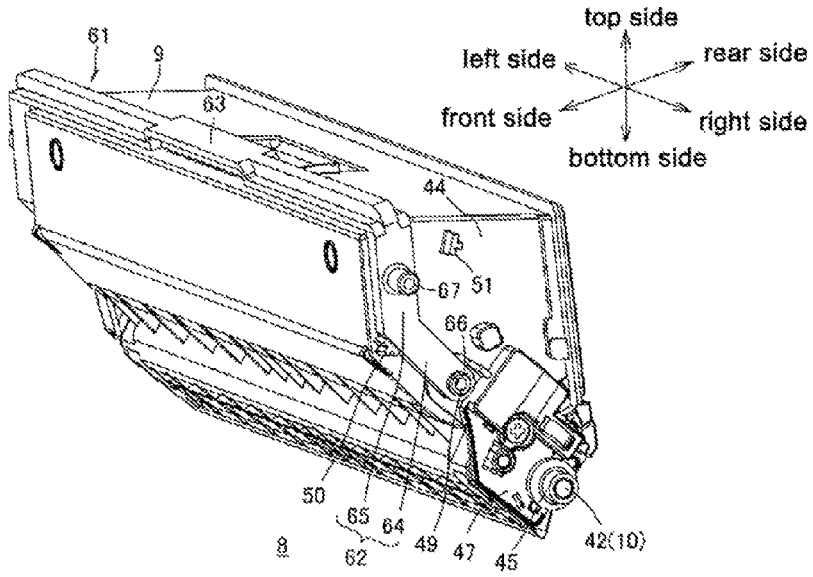
FIG. 10B is a perspective view of a developing cartridge according to the second modified example (a form in which a support axis is provided in a gear cover) viewed from the right-front thereof.

In the configuration shown in FIGS. 5A to 6D, each of the support shafts 48 and 49 is provided at the left side wall 43 and the right side wall 44 to protrude therefrom. However, a portion (position) where the support shafts 48 and 49 are formed is not limited to the left side wall 43 and the right side wall 44. For example, as shown in FIGS. 10A and 10B, each of the support shafts 48 and 49 may be formed at the gear cover 46 and the electrode cover 47 to protrude therefrom.

(3) Third Modified Example

The configuration shown in FIGS. 11A, 11B, 12A, and 12B may be adopted. In each drawing of FIGS. 11A to 12B, portions corresponding to each part shown in FIGS. 5A to 6D are designated with the same reference numerals as each part.

In this configuration, bearing parts 81 are provided on a left front end and a right front end of the upper surface of the case 9 of the developing cartridge 8, respectively. A bearing hole 82 is formed to pass through the bearing part 81 in a left-right direction.

A developing cartridge 8 includes a swing member 83. A swing member 83 integrally includes a pair of aims 84 and a connecting part 85 connecting the pair of the arms 84.

Right and left arms 84 are formed in a V shape when viewed from the side. A support shaft 86 extending toward the inside of a left-right direction is formed at a bent portion of each arm 84.

The connecting part 85 is provided between front ends of each of the arms 84 at the upper side of the case 9.

Figure 11A:
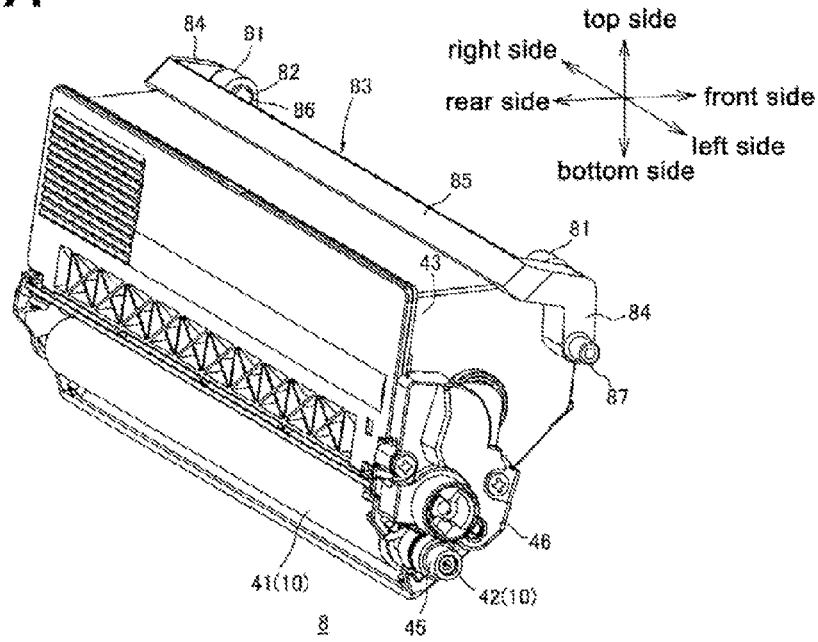
FIG. 11A is a perspective view of a developing cartridge according to a third modified example (a form in which a support axis is provided at a mid-portion of an arm) viewed from the left-rear thereof, in which a swing member takes a first posture.
Figure 11B:
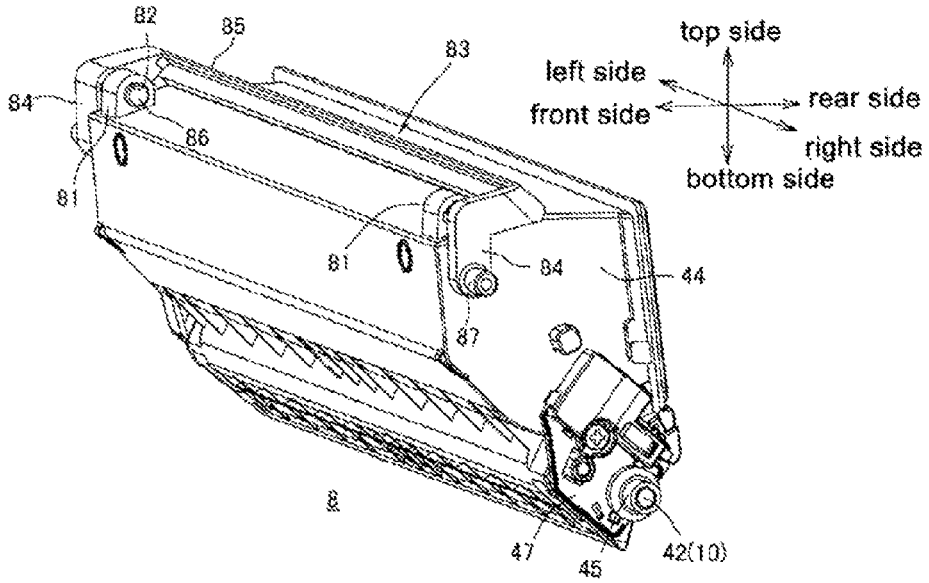
FIG. 11B is a perspective view of a developing cartridge according to the third modified example (a form in which a support axis is provided at a mid-portion of an arm) viewed from the right-front thereof, in which a swing member takes the first posture.
Figure 12A:
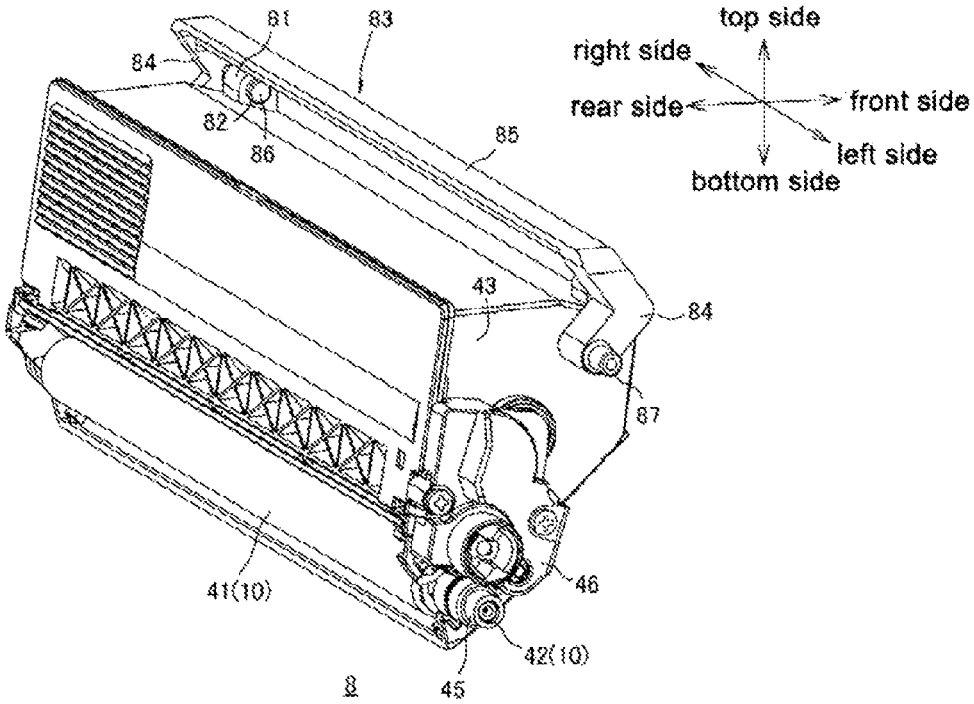
FIG. 12A is a perspective view of a developing cartridge according to the third modified example (a form in which a support axis is provided at a mid-portion of an arm) viewed from the left-rear thereof, in which a swing member takes a second posture.
Figure 12B:
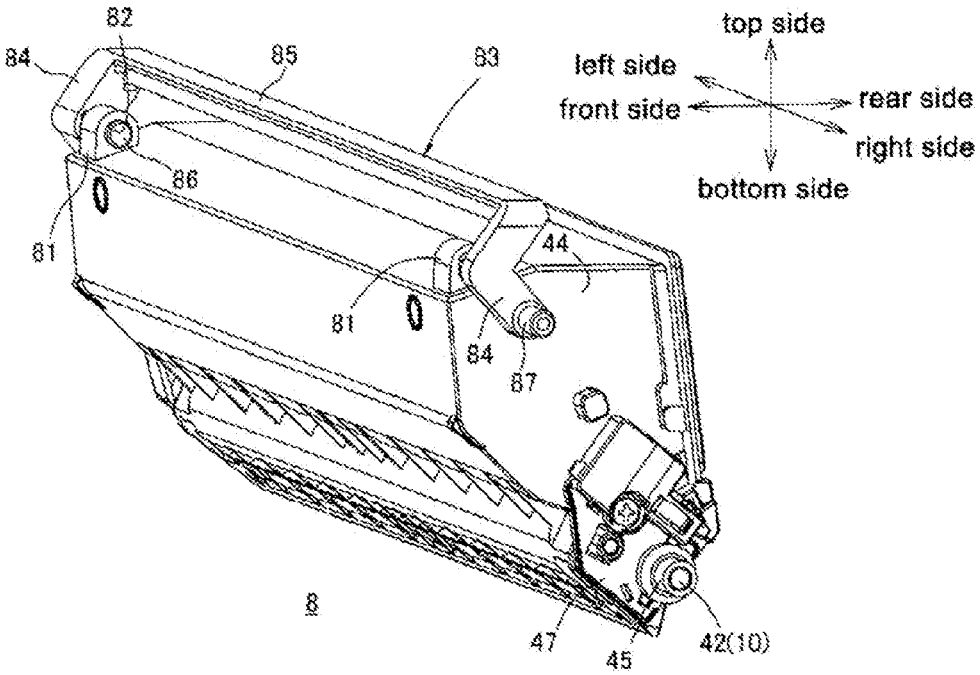
FIG. 12B is a perspective view of a developing cartridge according to the third modified example (a form in which a support axis is provided at a mid-portion of an arm) viewed from the right-front thereof, in which a swing member takes the second posture.

The support shaft 86 of each arm 84 is penetrated into the bearing hole 82 from the outside of a left-right direction while maintaining a sufficient clearance, such that the swing member 83 (the arm 84) is swingably provided in the first posture and the second posture based on the support shaft 86. While the swing member 83 takes the first posture, as shown in FIGS. 11A and 11B, the lower end of each arm 84 is disposed at the front end of the left side wall 43 and right side wall 44 of the case 9. While the swing member 83 takes the second posture, as shown in FIGS. 12A and 1213, the lower end of each arm 84 is disposed at a position separated from the rear-upper side with respect to the lower end in the state where the swing member 83 takes the first posture.

A cylindrical pressed part 87 is provided to protrude toward the outside of the left-right direction at the lower end of each arm 84.

Even in this configuration, the same effect as the configuration shown in FIGS. 5A to 6D may be achieved.

(4) Other Modified Examples

In the configuration shown in FIGS. 5A to 6D, support shafts 48 and 49 instead of the through-hole 66 may be formed to protrude toward the inside of the left-right direction at a position where the through-hole 66 is formed at the arm 62 and the front ends of the support shafts 48 and 49 may be rotatably supported at the left side wall 43 and right side wall 44, respectively.

In the configuration shown in FIGS. 10A and 10B, the support shafts 48 and 49 instead of the through-hole 66 may be formed to protrude toward the inside of the left-right direction at a position where the through-hole 66 is formed at the arm 62 and the front ends of the support shafts 48 and 49 may be rotatably supported at the gear cover 46 and the electrode cover 47, respectively.

In the configuration shown in FIGS. 11A to 12B, support shaft 86 instead of the bearing hole 82 may be formed to protrude toward the outside of the left-right direction at a position where the bearing hole 82 is formed at each bearing part 81 and each of the front ends of the support shaft 86 may be rotatably supported at the bent portion of the arm 84.

Although in the above embodiments, the pair of arms 62 are provided in the developing cartridge, a single arm may be provided in the developing cartridge. In this case, the single arm is attached to one of the left side wall 43 and the right side wall 44, and the other side wall is not provided with the arm. Further, in this case, the connecting portion 63 connecting the pair of arms 62 may be not provided in the developing cartridge.

Besides, the above configuration can be variously designed and changed within the range of the gist of the disclosure.

What is claimed is:

1. A developing cartridge detachable from a photosensitive unit including a photosensitive drum and a pressing member, the developing cartridge comprising:

a developing roller configured to rotate about a first axis extending in a first direction, the developing roller having a first side and a second side opposite to the first side in the first direction;

a case including a first wall disposed at the first side of the developing roller and a second wall disposed at the second side of the developing roller; and a first arm configured to be supported by the first wall of the case and configured to swing between a first posture and a second posture about a second axis extending in the first direction, the first arm including a first protrusion projecting from the first arm in the first direction, wherein the first protrusion includes a first pressed part configured to receive a pressing force from the pressing member, and wherein, in a state in which the developing cartridge is attached to the photosensitive unit and the photosensitive drum contacts the developing roller, the first arm is configured to take the first posture in which the developing roller is pressed against the photosensitive drum by the pressing force applied to the first pressed part from the pressing member, and the second posture in which the first pressed part is released from being pressed by the pressing member.

2. The developing cartridge according to claim 1, further comprising a first support shaft provided between the first wall of the case and the first arm, and extending in the first direction, wherein the first arm is swingably supported by the first support shaft.

3. The developing cartridge according to claim 2, wherein one end of the first support shaft is fixed to the first wall of the case and another end thereof is inserted into and loosely fitted to a through-hole formed at the first arm.

4. The developing cartridge according to claim 2, wherein an outside end surface of the first support shaft in the first direction is disposed further inside than an outside end surface of the first pressed part in the first direction.

5. The developing cartridge according to claim 1, wherein the first pressed part is integrally formed with the first arm.

6. The developing cartridge according to claim 1, wherein:

the first arm includes a first portion extending in a diameter direction of the developing roller and swingably connected to the first wall of the case at one end thereof, and a second portion extending from another end of the first portion in a direction from the first posture to the second posture with respect to an extending line following the first portion, and the first pressed part extends toward an outside of the first direction from the second portion.

7. The developing cartridge according to claim 1, further comprising a second arm configured to be supported by the second wall of the case and configured to swing between a third posture and a fourth posture about the second axis, the second arm including a second protrusion projecting from the second arm in the first direction.

8. The developing cartridge according to claim 7, wherein the second protrusion is a second pressed part that is configured to receive pressing force from outside.

9. The developing cartridge according to claim 8, wherein the second arm is configured to take the third posture when the second pressed part is pressed by the pressing force from the outside and the fourth posture when the pressing of the second pressed part by the pressing force from the outside is released.

10. The developing cartridge according to claim 9, further comprising a second support shaft provided between the second wall of the case and the second arm, and extending in the first direction, wherein the second arm is swingably supported by the second support shaft.

11. The developing cartridge according to claim 10, wherein one end of the second support shaft is fixed to the second wall of the case and another end thereof is inserted into and loosely fitted to a through-hole formed at the second arm.

12. The developing cartridge according to claim 10, wherein an outside end surface of the second support shaft in an axial direction is disposed further inside than an outside end surface of the second pressed part in the first direction.

13. The developing cartridge according to claim 7, wherein the second pressed part is integrally formed with the second arm.

14. The developing cartridge according to claim 8, wherein:

the second arm includes a first portion extending in a diameter direction of the developing roller and swingably connected to the second wall of the case at one end thereof, and a second portion extending from another end of the first portion in a direction from the third posture to the fourth posture with respect to an extending line following the first portion, and the second pressed part extends toward the outside of the first direction from the second portion.

15. The developing cartridge according to claim 7, wherein the first arm and the second arm are connected by a connection part.

16. The developing cartridge according to claim 15, wherein the connecting part is configured to act as a handle to be gripped by a user.

17. The developing cartridge according to claim 15, wherein the connecting part is integrally formed with the first arm and the second arm.

18. The developing cartridge according to claim 7, wherein the case includes:

a first stopper which projects from the first wall in the first direction and is configured to restrict movement of the first arm, and a second stopper which projects from the second wall in the first direction and is configured to restrict movement of the second arm.

19. The developing cartridge according to claim 18, wherein:

the case includes a third stopper which projects from the first wall in the first direction and is configured to restrict the movement of the first arm, and the first arm is disposed between the first and third stoppers.

20. The developing cartridge according to claim 19, wherein:

the case includes a fourth stopper which projects from the second wall in the first direction and is configured to restrict the movement of the second arm, and the second arm is disposed between the third and fourth stoppers.

* * * * *